US005203685A

United States Patent [19]

Andersen et al.

[11] Patent Number: 5,203,685

[45] Date of Patent: Apr. 20, 1993

[54] PISTON UNLOADER ARRANGEMENT FOR SCREW COMPRESSORS

[75] Inventors: Garry E. Andersen; Peter J. Linnert, both of La Crosse, Wis.

[73] Assignee: American Standard Inc., New York, N.Y.

[21] Appl. No.: 903,045

[22] Filed: Jun. 23, 1992

[51] Int. Cl.[5] ..... F01C 1/16

[52] U.S. Cl. ..... 418/1; 418/201.2

[58] Field of Search ..... 418/201.2, 1; 417/310, 417/440

[56] References Cited

U.S. PATENT DOCUMENTS

| | | | |
|---|---|---|---|
| 3,088,658 | 5/1963 | Wagenius | 418/201.2 |
| 4,042,310 | 8/1977 | Schibbye et al. | 417/310 |
| 4,544,333 | 10/1985 | Hirano | 417/299 |
| 4,565,508 | 1/1986 | Lindstrom | 418/201 |
| 4,575,323 | 3/1986 | Yoshimura | 418/201.2 |

*Primary Examiner*—Richard E. Gluck

*Attorney, Agent, or Firm*—William J. Beres; William O'Driscoll; Peter D. Ferguson

[57] ABSTRACT

A screw compressor employs a piston unloader which is disposed in a bore remote from the compressor's working chamber. Flow communication between the bore and working chamber is through a series of non-overlapping unloader ports. The unloader piston has a notched end face which effectively causes the unloader ports to overlap in operation. Precise and continuous capacity control of the compressor over a predetermined portion of its operating range is thereby achieved while internal high to low side gas leakage within the compressor and the clearance volume of the unloader ports is minimized. Compressor efficiency is thereby increased.

16 Claims, 3 Drawing Sheets

FIG. 1
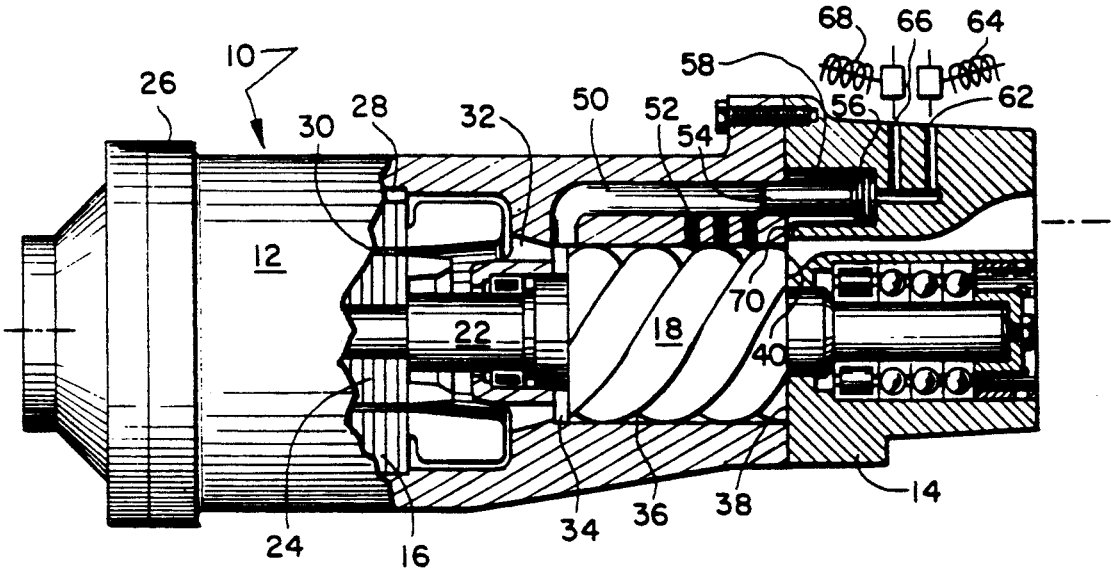
FIG. 2
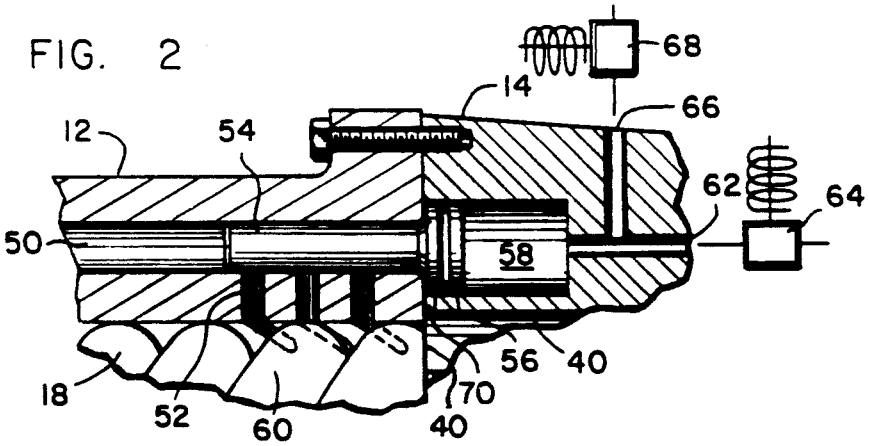
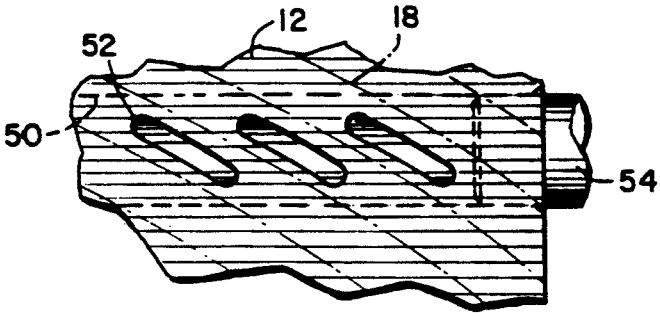
FIG. 3

PISTON UNLOADER ARRANGEMENT FOR SCREW COMPRESSORS

BACKGROUND OF THE INVENTION

The present invention relates apparatus for modulating the capacity of a rotary screw compressor. More particularly, the present invention relates an unloading arrangement for a refrigeration screw compressor which is characterized by the disposition of an unloading piston in a cylindrical bore which is remote from the compressor's working chamber but in flow communication with it through a series of non-overlapping unloader ports.

Screw compressor piston unloading arrangements of the type illustrated in U.S. Pat. Nos. 4,042 310; 4,544,333; 4,565,508; and co-pending U.S. patent application No. 07/747,894, which is incorporated herein by reference and which is assigned to the assignee of the present invention, are unloading arrangements which employ an axially movable or rotatable unloading piston disposed within a cylindrical bore remote from the compressor's working chamber The bore communicates with the working chamber through a series of axially arranged unloader ports and is additionally in flow communication with a portion of the compressor which is at compressor suction pressure in operation.

When the unloading piston in such arrangements is positioned within the unloader bore so as to completely interrupt communication of the bore with the compressor's working chamber through the unloader ports the compressor operates fully loaded because the compression pockets defined in the working chamber are prevented from unloading to suction through the unloader ports and bore The unloading piston is moved axially or is rotated within the bore to fully or partially cover or uncover the unloader ports in a sequential manner thereby providing for the selective and variable communication of the compression pockets within the working chamber back to suction for the purpose of unloading the compressor.

With respect to the arrangement in assignee's copending patent application and referring to FIGS. 1, 2 and 3 herein which are, respectively, FIGS. 1, 5 and 6 in assignee's co.pending patent application. FIG. 1 is a partial cross-sectional side view of a screw compressor illustrating piston unloader apparatus associated with the male rotor of a screw compressor with the unloader piston in the full unload position. Compressor 10 is comprised of a rotor housing 12 and bearing housing 14. A motor 16, male rotor 18 and female rotor (not shown) are disposed in the rotor housing. Shaft 22 extends from the male rotor and motor rotor 24 is mounted thereon.

Suction gas enters rotor housing 12 through the suction end 26 of the compressor and passes through a suction strainer (not shown) prior to passing through and around motor 16 in a manner which cools the motor. In this regard, suction gas passing through and around motor 16 passes out of motor-rotor housing gap 28, rotor-stator gap 30 and into suction area 32 within the rotor housing. The gas next passes from suction area 32, through suction port 34 and into the working chamber 36 where it is enveloped in a chevron shaped compression pocket defined by the wall of the working chamber and the intermeshed lobes of male rotor 18 and the female rotor.

As the male and female rotors rotate, the pocket in which the suction gas is initially enveloped is closed off from suction port 34 and is circumferentially displaced toward high pressure end wall 38 of the compressor s working chamber. As such displacement occurs, the volume of the pocket is reduced and the gas contained therein is compressed until such time as the pocket opens to discharge port 40.

Rotor housing 12 defines a cylindrical bore 50 which is in flow communication with suction port 34 or some other area of the compressor or system in which the compressor is employed which is at suction pressure. Rotor housing 12 also defines a series of ports 52 which communicate between bore 50 and working chamber 36. Disposed in bore 50 is an unloader piston 54 which includes a control portion 56 disposed in a chamber 58 defined by the bearing housing. Unloader piston 54 is axially positionable within bore 50 so as to provide for the selective occlusion of ports 52.

Ports 52 are generally elongated axially running curvilinear slots defined in the wall of working chamber 36 of the rotor housing. Ports 52 overlap each other in the axial sense so as to provide, through their interaction with unloader piston 54, for an essentially continuous unloading path from the male rotor portion of the working chamber into bore 50. The length of that path and, therefore, the capacity of the compressor is determined by the position of piston 54 within bore 50 and the extent to which ports 52 are occluded by the unloader piston.

Piston 54 is preferably hydraulically actuated with chamber 58 being in flow communication with a source of pressurized fluid, such as the lubricant employed within the compressor, through passage 62 in which a solenoid operated load valve 64 is disposed. Chamber 58 is likewise in flow communication with passage 66 in which a solenoid operated unload valve 68 is disposed.

By porting oil which is at discharge pressure through load valve 64 with unload valve 68 closed, piston 54 is caused to move axially toward suction end 26 of the compressor thereby further loading the compressor through the occlusion of additional ones of ports 52 or a portion thereof. Contrarily, the opening of unload solenoid 68, with load valve 64 closed, places passage 66 in flow communication with a portion of compressor 10 which is at less than suction pressure thereby permitting discharge pressure gas, which is communicated through passage 70 into chamber 58 to act on the side of control portion 56 of piston 54 opposite from the side operated on by a pressurized fluid. This causes piston 54 to move away from the suction end of the compressor which causes the compressor to unload as additional ones or parts of unloader ports 52 are opened.

As is noted in assignee's co.pending U.S. Pat. application, unloading ports 52 effectively overlap each other, in the axial sense, so as to provide an essentially continuous unloading path from the male rotor portion of the working chamber into the unloader bore and for essentially continuous compressor unloading along that path. This essentially continuous unloading path results from the overlap of the unloading ports. The unloading piston has an essentially flat end face so that as soon as unloader 54 is moved to completely occlude or uncover a first unloader port any further movement of it will begin to occlude or uncover the next unloader port in its direction of travel. It is the interaction of this type of unloader piston with the overlapping unloader ports which permits the continuous unloading of the compressor.

It has been determined that the use of elongated overlapping unloader ports, such as those described in assignee's co-pending patent application with the unloader piston taught therein, while allowing for the essentially continuous unloading of a screw compressor, brings with it certain disadvantages in the form of a less formidable seal against leakage between adjacent ones of the unloader ports around the unloader piston. Such leakage together with the relatively large clearance volume of the elongated unloader ports, results in compressor efficiencies and capacities which can be improved upon.

Such improved efficiencies and capacities are necessary to make screw compressors with their very distinct advantage of being able to be unloaded over a continuous operating range, economically competitive with the other, less expensive compressor designs against which they must compete in lower capacity ranges. Therefore, the need to improve upon the unloading arrangement associated with the male rotor of the screw compressor in assignee's co-pending patent application and screw compressor unloaders in the general sense to achieve improved compressor efficiency and increased capacity was identified.

SUMMARY OF THE INVENTION

It is an object of the present invention to provide unloading apparatus for a screw compressor which provides for continuous compressor unloading over a predetermined portion of the compressor's operating range.

It is another object of the present invention to provide for an economical screw compressor, of relatively small capacity, the capacity of which is capable of being modulated over a predetermined and continuous portion of its operating range, in a manner which minimizes the clearance volume and leakage associated with the unloader arrangement, so that compressor capacity and efficiency is increased.

With these objects of the present invention in mind and others which will become apparent when the drawing figures and following Description of the Preferred Embodiment are considered, the present invention is directed to piston unloading apparatus for a screw compressor which permits the unloading of the compressor over a smooth and continuous portion of its operating range by the selective occlusion a series of non-overlapping unloader ports which communicate between the compressor's working chamber and a bore which is remote therefrom and which is also in communication with an area of the compressor at suction pressure. A modified unloader piston is disposed in the unloader bore and interacts with the non-overlapping unloader ports so that a smooth and continuous transition between the unloader ports is achieved in a manner which eliminates the requirement that the ports overlap each other.

A notch is machined into the end of the unloader piston which effectively permits the axially spaced non-overlapping unloader ports to overlap in operation while providing a seal within the unloader bore around the circumference of the piston unloader at both the full load and full unload positions. Internal leakage within the compressor is therefore reduced. Because the unloader ports do not physically overlap although due to the nature of the unloader piston they do, in effect the clearance volumes defined by the ports is reduced. These factors cooperate to increase compressor capacity and efficiency while still permitting the continuous unloading of the compressor in the same manner as is accomplished by unloader arrangements in which the unloader ports overlap.

DESCRIPTION OF THE DRAWINGS FIGURES

FIGS. 1, 2 and 3, as noted above, are drawing FIGS. which appear in assignee's co.pending U.S. patent application Ser. No. 07/747.894. They illustrate an unloader arrangement for a screw compressor in which an unmodified flat-ended unloader piston is controllably moved within a cylindrical bore to selectively occlude unloader ports which overlap.

FIGS. 4*a*. 4*b* and 4*c* illustrate the unloading arrangement of the present invention in which a modified piston unloader interacts with unloader ports which do not overlap. The unloader piston is illustrated in full unload intermediate and full load positions respectively.

DESCRIPTION OF THE PREFERRED EMBODIMENT

Figure 4A:
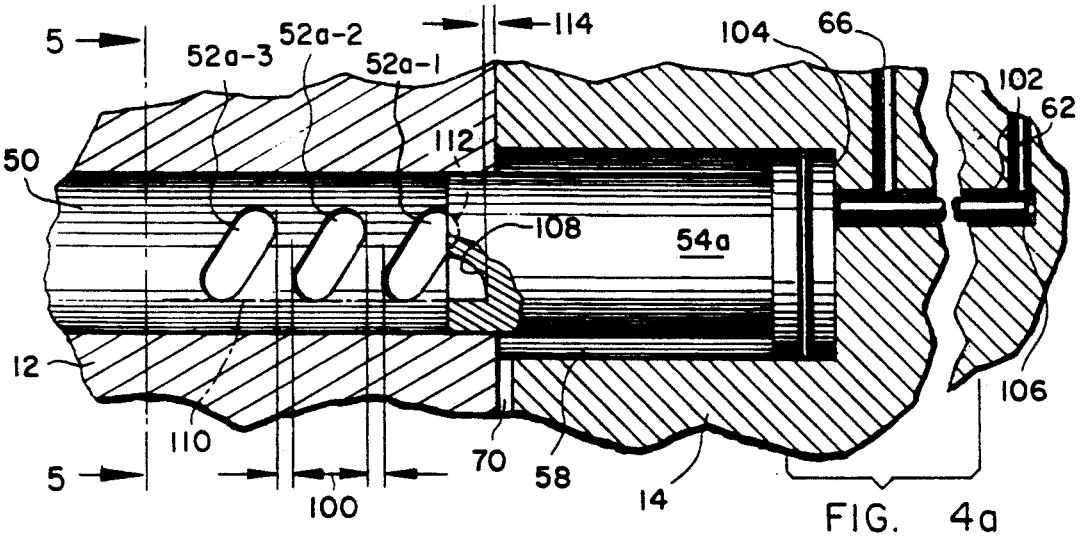

It is to be noted at the outset that the reference numerals and components of Drawing FIGS. 1, 2 and 3 when referred to hereinafter are the same in purpose, effect and connotation with respect to the present invention as they are with respect to the invention of applicant's copending patent application with the exception of the unloader ports and unloader piston. In that regard, the unloader ports referred to by reference numeral 52 in FIGS. 1, 2 and 3 herein and in assignee's co.pending patent application are, for purposes of the present invention, referred to as unloader ports 52*a* in Drawing FIGS. 4*a*, 4*b*, 4*c* and 5 Likewise. unloader piston 54 in Drawing FIGS. 1, 2 and 3, for purposes of the present invention, is referred to as unloader piston 54*a* in Drawing FIGS. 4*a*, 4*b*, 4*c* and 5.

Figure 4B:
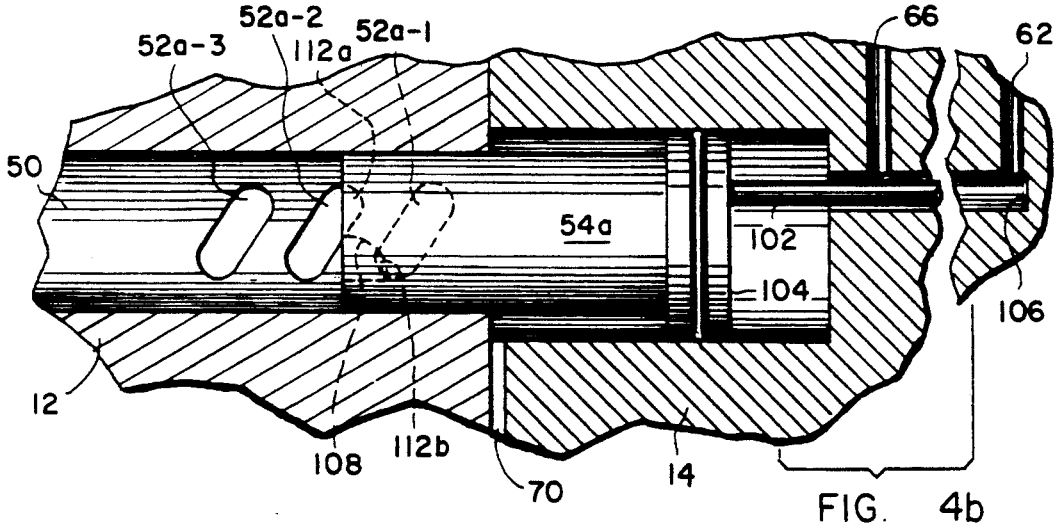
Figure 4C:
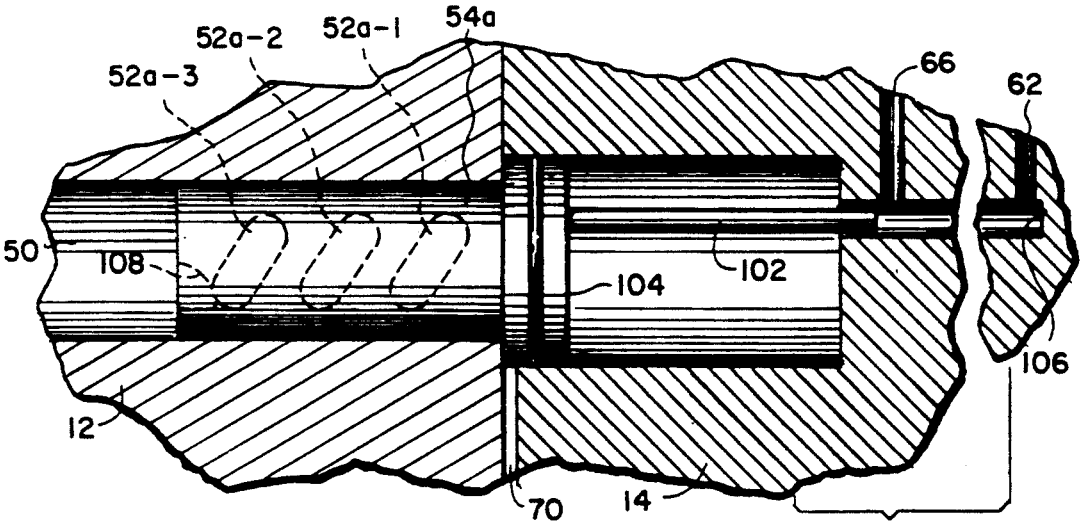

Having described Drawing FIGS. 1. 2 and 3 in the Background of the Invention above, the readers attention is directed to Drawing FIGS. 4*a* 4*b*, 4*c* and 5 which illustrate the present invention as applied to the compressor previously described and illustrated in FIGS. 1, 2 and 3. As is indicated by arrows 100 in FIG. 4*a*, unloader ports 52*a* of the present invention do not overlap and are separated in an axial sense with respect to their opening into the compressor's working chamber 36 and into bore 50. It is to be noted that the unloader port closest to the discharge end of rotor housing 12 in FIGS. 4*a*, 4*b* and 4*c* is denominated port 52*a*.1 while the intermediate unloader port is denominated 52*a*.2 and the port closest to the suction end of the compressor 52*a*.3.

Unloader piston 54*a*, as has been previously discussed with respect to Drawing FIGS. 1, 2 and 3 and as will further be discussed, is axially moveable and controllably positionable within bore 50 between the full unload position illustrated in FIG. 4*a* and the full load position illustrated in FIG. 4*c*. Unloader piston 54*a* includes a rod 102 which extends from its back face 104. Piston 54*a* is hydraulically acted upon by a pressurized fluid, as has been described, so as to position the unloader piston within bore 50.

Rod 102 is of a length such that a portion of it always remains within passage 106, which is a passage in communication with chamber 58 and passages 62 and 66, irrespective of the axial position of unloader piston 54*a* in bore 50. Since passage 106 and rod 102 are off center with respect to the center of back face 104 of unloader piston 54*a*, rod 102 acts to prevent unloader piston 54*a* from rotating within chamber 58 and bore 50. It will be apparent that other means for preventing the rotation of the unloader piston would serve the purpose and fall within the scope of the present invention.

Notch 108 is machined into the end of unloader piston 54*a* and, in operation, overlaps adjacent unloader ports 52*a* in certain of its positions while still permitting the full circumferential sealing of bore 50 by the unloader piston in both the full load and full unload positions. Notch 108 is preferably machined with a milling cutter and defines a 90° included angle. Changes from the 90° included angle are permissible and within the scope of the present invention although the machining of such angles would be more complicated and expensive.

Figure 5:
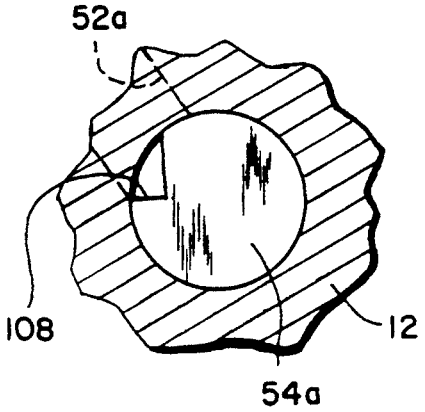
FIG. 5 is an end view of the piston unloader of the present invention taken along line 5—5 of FIG. 4*a*.

Piston 54*a* is positioned within bore 50 and chamber 58 and is maintained there, in the sense of its angular orientation with respect to the centerline thereof, by the disposition of rod 102 in passage 106. This orientation is such that the edge of the vee-shaped notch is maintained in alignment with the edges of unloader ports 52*a* as is indicated by line 110 in FIG. 4*a* and as is illustrated in FIG. 5.

Referring now primarily to FIG. 4*a*, piston unloader 54*a* is illustrated in its full unload position. It is to be noted that piston 54*a* in the full unload position slightly overlaps a portion 112 of unloader port 52*a*.1. This overlap ensures that any movement of the unloader piston to load the compressor by further occluding port 52*a*.1 has immediate effect and causes an immediate capacity change in the compressor.

This is of particular importance because although the position of piston unloader 54*a* is hydraulically controlled, the control of those hydraulics (and therefore compressor capacity) is electronic through the control of load and unload solenoid valves 64 and 68 which allows for the very precise control of compressor capacity. Such electronic control is predicated on the relatively very small changes in compressor capacity which result from even very small movements of the unloader piston and which are manifested by a change in the current draw of motor 24.

It is to be noted, still primarily with respect to FIG. 4*a*, that notch 108 is formed such that there can be no leakback through notch 108 to bore 50 from chamber 58. It will be remembered that bore 50 is in communication with compressor suction while chamber 58 is at discharge pressure through passage 70. In that regard, circumferential area 114 of piston 54*a* acts as a seal to prevent communication between bore 50 and chamber 58, through notch 108, when unloader piston 54*a* is in the full unload position.

It is also to be noted, still referring primarily to Drawing FIG. 4*a* that while piston 54*a* does overlap unloader port 52*a*.1 in the full unload position, notch 108 does not. Therefore, compressor capacity when the compressor is running fully unloaded, is unaffected by notch 108. It will be appreciated however that soon as unloader piston 54*a* is caused to move toward the suction end of the compressor so as to further load the compressor, notch 108 interacts with unloader port 52*a*.1 in a manner which causes a very level, controllable, slow and smooth increase in compressor capacity.

Referring primarily now to FIG. 4*b*, unloader piston 54*a* is illustrated in an intermediate position in which the end of unloader piston 54*a* in which notch 108 is defined overlaps middle unloader port 52*a*.2 in an area 112*a* while notch 108 itself very slightly overlaps unloader port 52*a*.1 in area 112*b* but not port 52*a*.2. Port 52*a*.2 is sufficiently closed by the portion of un-notched piston 54*a*, in this position, to transfer capacity control to that port just prior to capacity control through port 52*a*.1 and notch 108 being lost. This results in a smooth and continuous capacity control change where there would otherwise be a deadband due to the axial separation of the unloader ports (areas 100 in FIG. 4*a*).

Referring next to FIG. 4*c*, unloader piston 54*a* is shown in the full load position wherein communication of all of unloader ports 52*a*.1 52*a*.2 and 52*a*.3 and, therefore, the working chamber with bore 50 is prevented. Notch 108 is immediately adjacent but not in communication with unloader port 52*a*.3 so that as soon as piston 54*a* is caused to move to unload the compressor, communication is established between the compressor's working chamber and bore 50 through notch 108. Instantaneous and precise unloading of the compressor is thereby established as soon as piston 54*a* moves out of the full load position.

The immediate proximity of notch 108 to unloader port 52*a*.3 in the full load position which essentially amounts to line contact, is accomplished through the accurate machining of the unloader piston and the alignment of notch 108 with the unloader ports in bore 50 as heretofore described. Such alignment is accomplished, once again, by the disposition of rod 102 in hydraulic passage 106.

It is noted that rod 102 could be accommodated in its own, dedicated guide passage. However, the use of lubricant passage 106 is economical as it adds no cost to the compressor. Passage 106 is preferably positioned such that it opens into chamber 58 at the outer periphery of the backface of the unloader piston, so as to prevent piston rotation to the maximum extent possible and to prevent vee-notch to unloader port misalignment, while maintaining the clearance necessary for the flow of control hydraulics within it.

It is to be noted that as is typical in most refrigeration screw compressors, a relatively large amount of compressor lubricant is carried into and through the working chamber of the compressor so that in addition to the gas being compressed within the working chamber there is a large amount of oil entrained therein. Therefore, even if there is a slight overlap of notch 108 with unloader port 52*a*.3 in the full load position of FIG. 4*c*, the effect on compressor capacity will be negligible because the area of the overlap will be flooded with oil. As a result, a liquid seal is formed and any leakage from the working chamber through the unloader port into bore 50 which does occur will be of oil and not refrigerant gas.

It is also to be noted that there is an added benefit to using passage 106 as a housing for rod 102. In that regard, rod 102 fills a large portion of the volume of passage 106. The oil used to actuate unloader piston 54*a* is, as noted above, oil the primary use of which in the compressor is compressor lubrication A small portion of such oil is redirected within the compressor and through an extremely small metering orifice (not shown) to control the position of unloader piston 54*a*.

The diameter of passage 106 is not required to be significantly larger than the control orifice diameter. However, the drilling of such extremely narrow passages to any significant depth in steel or cast iron is impractical with the result that in actuality such passages are much wider and of greater volume than they need be. Therefore an additional volume of oil must be metered through the control orifice and into passage 106 before movement of the unloader piston will result. Because rod 102 is disposed in passage 106 in a close fitting manner and eliminates the need for an additional volume of oil simply to fill the passage before the oil can effect the movement of the unloader piston, the responsiveness of the unloader piston, particularly in the full unload position, is beneficially increased.

Figure 6:
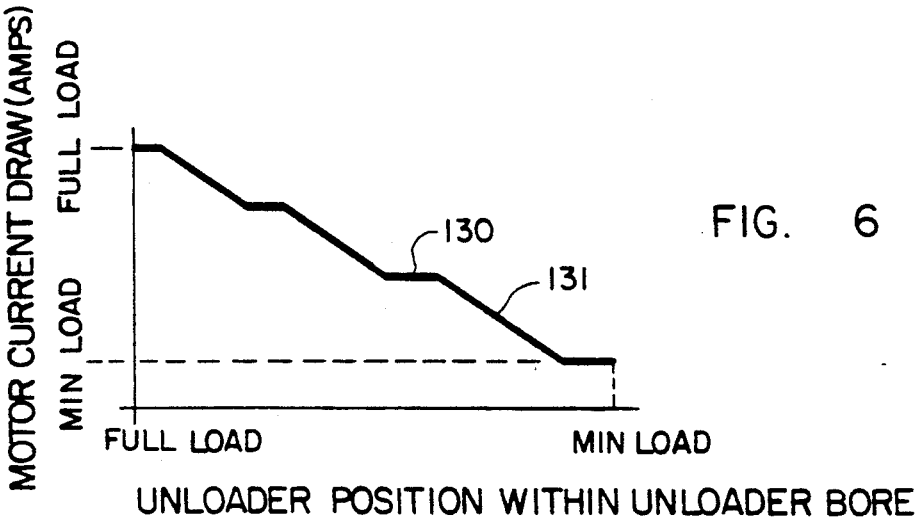
FIGS. 6 illustrates an unloading curve for compressor having non-overlapping unloader ports.
Figure 7:
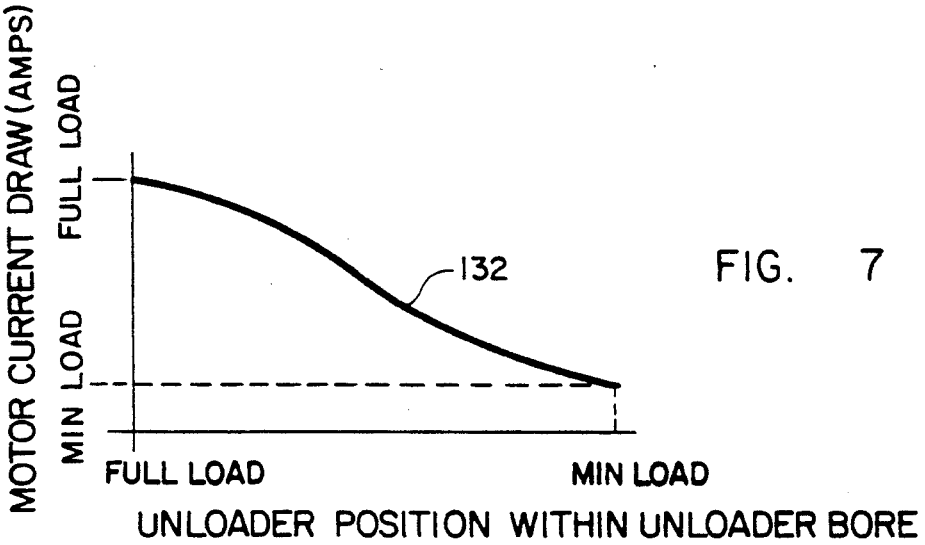
FIG. 7 illustrates an unloading curve for a compressor having unloader ports which overlap, whether physically or in effect.

Referring now to FIGS. 6 and 7, FIG. 6 illustrates the unloading characteristics of the screw compressor having non-overlapping unloader ports which are in the nature of those illustrated in FIGS. 4*a*, 4*b* and 4*c* but where an unmodified unloader piston, such as the one illustrated in FIGS. 1, 2 and 3 having no relieved or notch portion, is employed. It will be appreciated, as is illustrated by plateaus 130 in the unloading curve 131 of FIG. 6, that the unloading of the compressor in such instances is discontinuous since there will be a portion of unloader piston travel which has no effect with respect to the covering or uncovering of an unloader port Such an unloading arrangement, being stepwise rather than continuous, is less efficient with respect to the control of compressor capacity. less responsive and is not conducive to precise electronic control.

Because precise and continuous control of compressor capacity is advantageous, the nonresponsiveness associated with plateaus 130 must preferably be eliminated. In doing so, however, it must be remembered that the use of overlapping adjacent unloader ports, while allowing for the continuous unloading of a compressor as illustrated by unloading curve 132 in FIG. 7 and as is taught in assignee's co-pending patent application, results in certain compressor characteristics which can be improved upon.

The unloading arrangement of the present invention, through the use of non-overlapping unloader ports which effectively overlap in operation through the use of a modified unloader piston, minimizes internal leakage within the compressor and results in increased compressor efficiency through reduced clearance volumes while permitting the achievement of the smooth, continuous and precise compressor unloading illustrated by capacity curve 132 in FIG. 7. As a result, heretofore unobtainable efficiency and versatility in the capacity control of economically manufacturable, relatively small capacity screw compressors, which must compete with compressors of entirely different and less expensive design is made possible.

While the present invention has been described in terms of a preferred embodiment, it will be appreciated by those skilled in the art that many modifications of the present invention are contemplated hereby so that the scope of the present invention is to be limited only in accordance with the language of the claims which follow.

What is claimed is:

1. A screw compressor comprising:

a housing defining a working chamber, a bore remote from said working chamber and a plurality of ports communicating therebetween said ports being spaced apart so that no portion of any one of them overlaps a adjacent port along said bore; and means, disposed for axial movement within said bore, for unloading said compressor in a continuous manner by providing an uninterrupted unloading path from said working chamber to said bore through said ports.

2. The screw compressor according to claim 1 wherein said means for unloading comprises means for placing adjacent ones of said ports in flow communication with each other through said bore

3. The screw compressor according to claim 2 wherein said means for placing adjacent ones of said unloader ports in flow communication within said bore comprises an unloader piston, said piston defining a notch and being positionable in and between a full unload position and a full load position.

4. The screw compressor according to claim 3 wherein a first portion of said unloader piston is located in said bore irrespective of the position of said unloader piston, said first portion defining said notch.

5. The screw compressor according to claim 3 wherein said notch is aligned within said bore for communication with said ports.

6. The screw compressor according to claim 3 wherein said piston is configured so that at least a portion of said notch is in communication with at least one of said ports other than when said unloader piston is in said full load and said full unload positions.

7. The screw compressor according to claim 3 further comprising means for preventing the rotation of said unloader piston.

8. The screw compressor according to claim 3 wherein said unloader piston includes an uninterrupted circumferential seal portion disposed within said bore when said unloader piston is in said full unload position.

9. A screw compressor comprising:

a rotor housing defining a generally axially running working chamber and an unloader bore generally parallel thereto, said working chamber and said unloader bore being in flow communication through a plurality of ports, said ports being axially spaced along said bore so that no portion of a first port overlaps a second port along the axis of said bore, said bore being in flow communication with a portion of said compressor which is at compressor suction pressure when said compressor is in operation;

an unloader piston disposed in said bore for axial movement therein between a full load and a full unload position, said piston being configured to provide a flow path between said working chamber and said bore through at least one of said ports other than when said piston is in said full load position; and means for controllably positioning said piston in said bore so as to provide for the continuous unloading of said compressor over at least a predetermined portion of the compressor's operating range.

10. The compressor according to claim 9 wherein said unloader piston defines a notch, said notch being aligned in said bore for communication with said ports.

11. The compressor according to claim 10 wherein in said full load position, flow from said working chamber to said bore through said ports is prevented by said piston.

12. The compressor according to claim 11 wherein in said full unload position said piston defines an uninterrupted circumferential seal portion within said bore.

13. The compressor according to claim 12 wherein said notch is moved into communication with at least one of said ports immediately subsequent to the movement of said piston out of said full load position.

14. The compressor according to claim 13 wherein said notch is moved into communication with at least one of said ports immediately subsequent to the movement of said piston out of said full unload position.

15. The compressor according to claim 13 wherein a portion of said piston, other than the portion in which said notch is defined, occludes at least a portion of one of said ports in said full unload position.

16. A method for unloading a screw compressor where said compressor defines a working chamber a bore running generally parallel thereto and where said working chamber and bore communicate through a plurality of non-overlapping ports spaced along said bore comprising the steps of:

disposing a piston unloader in said bore said piston unloader configured so as to cause said non-overlapping ports to overlap in effect by providing a flow path therebetween; and controllably positioning said piston unloader in said bore in and between a full load and a full unload position so that at least one of said ports is in flow communication with said bore at all times other than when said piston is in said full load position.

* * * * *